US011377814B2

(12) United States Patent
Kim

(10) Patent No.: US 11,377,814 B2
(45) Date of Patent: Jul. 5, 2022

(54) ENERGY RECUPERATION SYSTEM AND METHOD FOR CONSTRUCTION EQUIPMENT

(71) Applicant: Volvo Construction Equipment AB, Eskilstuna (SE)

(72) Inventor: Dongsoo Kim, Gyeongsangnam-do (KR)

(73) Assignee: Volvo Construction Equipment AB, Eskilstuna (SE)

( * ) Notice: Subject to any disclaimer, the term of this patent is extended or adjusted under 35 U.S.C. 154(b) by 112 days.

(21) Appl. No.: 16/762,549

(22) PCT Filed: Nov. 8, 2017

(86) PCT No.: PCT/KR2017/012624
§ 371 (c)(1),
(2) Date: May 8, 2020

(87) PCT Pub. No.: WO2019/093537
PCT Pub. Date: May 16, 2019

(65) Prior Publication Data

US 2021/0372078 A1 Dec. 2, 2021

(51) Int. Cl.
*F15B 21/14* (2006.01)
*E02F 3/43* (2006.01)
(Continued)

(52) U.S. Cl.
CPC ..... *E02F 3/435* (2013.01); *E02F 3/32* (2013.01); *E02F 9/2217* (2013.01); *F15B 21/14* (2013.01);
(Continued)

(58) Field of Classification Search
CPC ..... F15B 21/14; F15B 2211/761; F15B 2211/88; E02F 9/2217
See application file for complete search history.

(56) References Cited

U.S. PATENT DOCUMENTS 6,971,463 B2 * 12/2005 Shore ..... B60K 6/12 180/165
8,997,476 B2 * 4/2015 Brinkman ..... E02F 9/2217 60/414

(Continued)

FOREIGN PATENT DOCUMENTS

CN 105715596 A 6/2016
WO WO-2016017802 A1 * 2/2016 ..... F15B 21/14

OTHER PUBLICATIONS

International Search Report and Written Opinion of the International Searching Authority, PCT/KR2017/012624, dated Jul. 27, 2018, 16 pages.

*Primary Examiner* — Thomas E Lazo
(74) *Attorney, Agent, or Firm* — Sage Patent Group

(57) ABSTRACT

An energy recuperation system for construction equipment includes an actuator driving upward and downward operations of a work unit; an accumulator connected to the actuator; and a controller determining a predicted downward mode associated with the downward operation of the work unit, regulating a dischargeable lowest limit pressure of the accumulator to a target pressure corresponding to the predicted downward mode, and charging the accumulator having the dischargeable lowest limit pressure regulated to the target pressure with pressurized oil discharged from the actuator during the downward operation of the work unit to recuperate energy, and an energy recuperation method.

20 Claims, 6 Drawing Sheets

(51) Int. Cl.
*E02F 3/32* (2006.01)
*E02F 9/22* (2006.01)

(52) U.S. Cl.
CPC ... *F15B 2211/212* (2013.01); *F15B 2211/625* (2013.01); *F15B 2211/761* (2013.01); *F15B 2211/88* (2013.01)

(56) References Cited

U.S. PATENT DOCUMENTS

| | | | | |
|---|---|---|---|---|
| 9,382,927 | B2 * | 7/2016 | Ankargren | F15B 21/14 |
| 2004/0118623 | A1 | 6/2004 | Shore et al. | |
| 2014/0208728 | A1 * | 7/2014 | Ma | F15B 11/042 60/327 |
| 2015/0192149 | A1 * | 7/2015 | Ma | E02F 9/2296 60/327 |
| 2016/0002889 | A1 | 1/2016 | Kajita et al. | |
| 2016/0238041 | A1 * | 8/2016 | Kajita | E02F 9/2296 |
| 2017/0009428 | A1 | 1/2017 | Hijikata et al. | |
| 2017/0198731 | A1 * | 7/2017 | Sugano | E02F 9/2289 |

* cited by examiner

[Fig. 1]
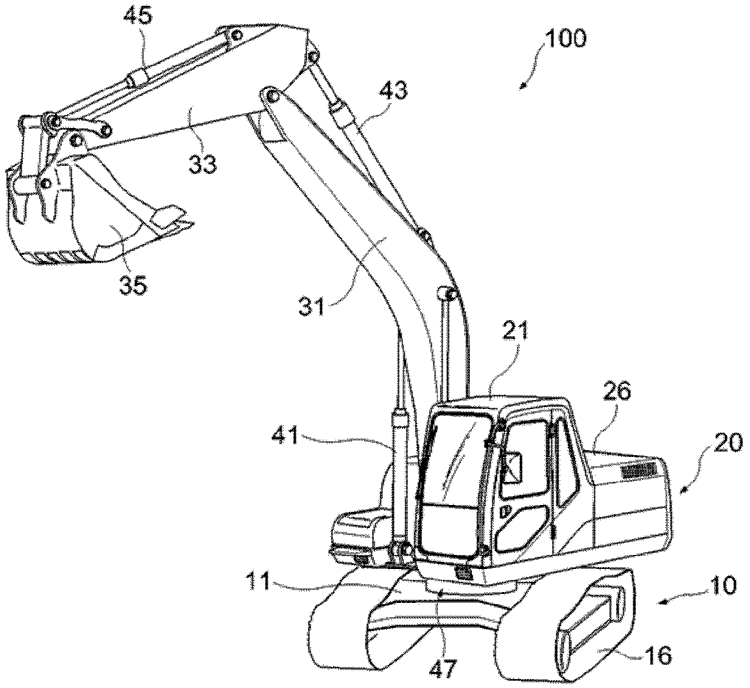
[Fig. 2]
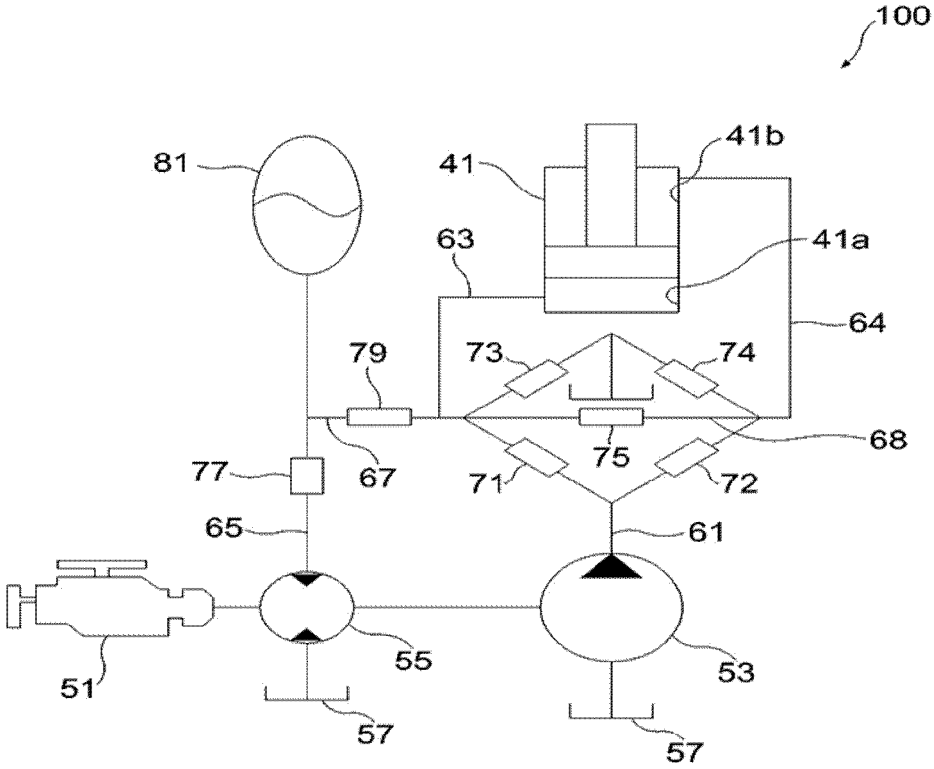

[Fig. 3]
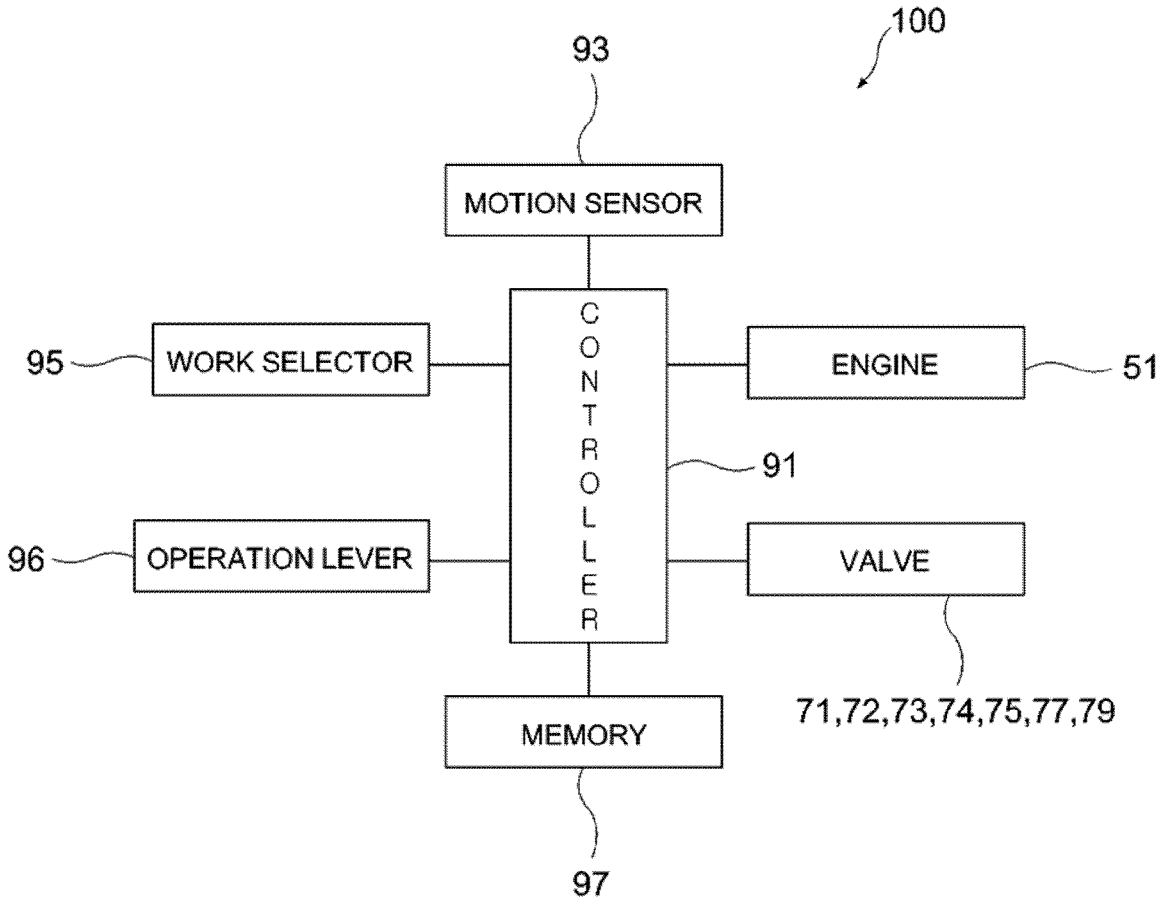
[Fig. 4]
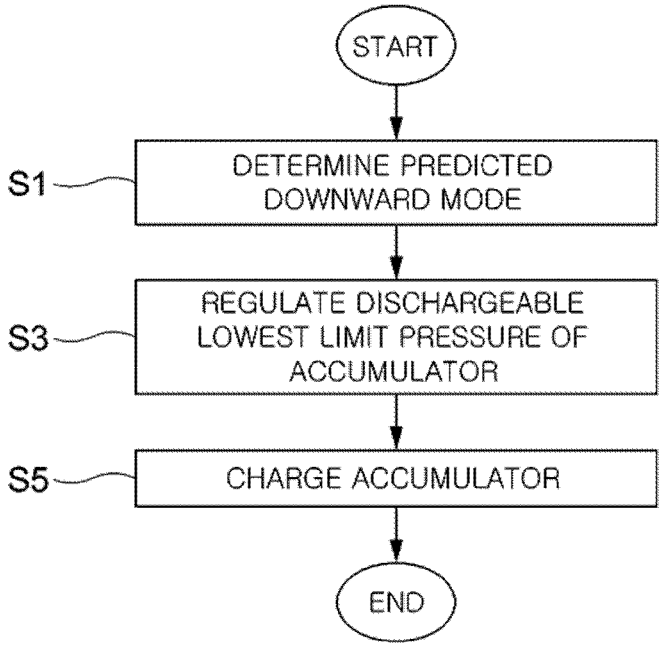

[Fig. 5]
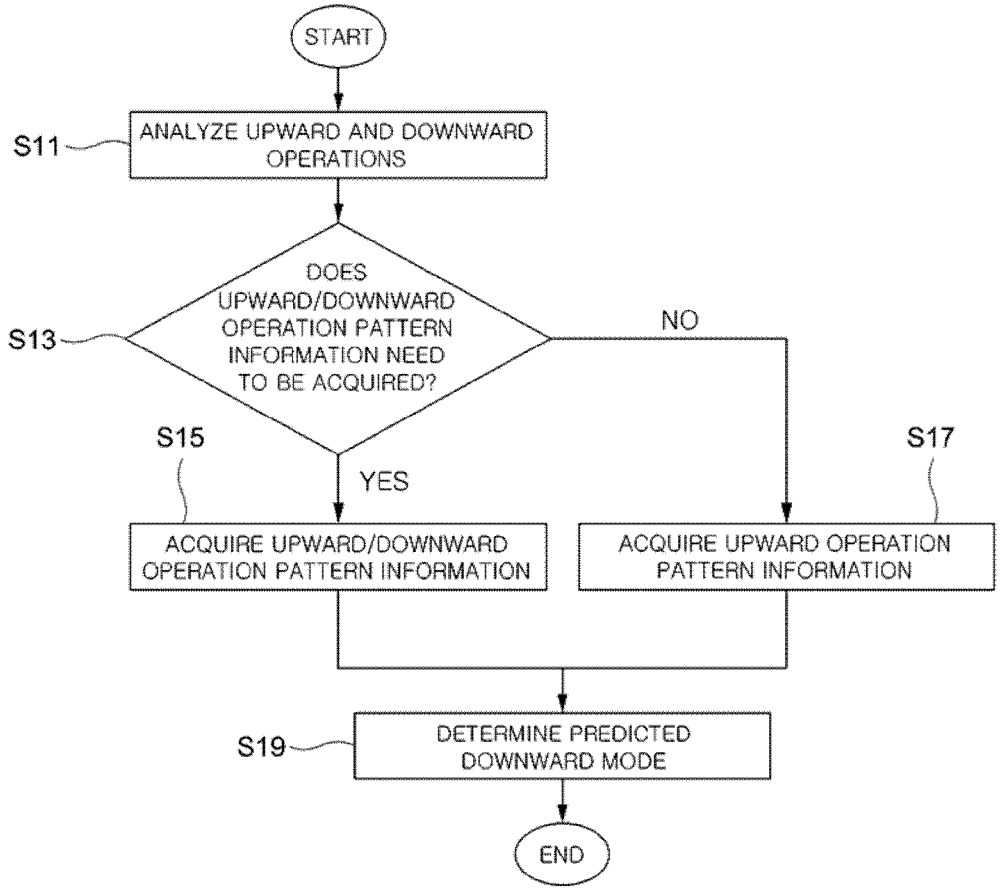
[Fig. 6]
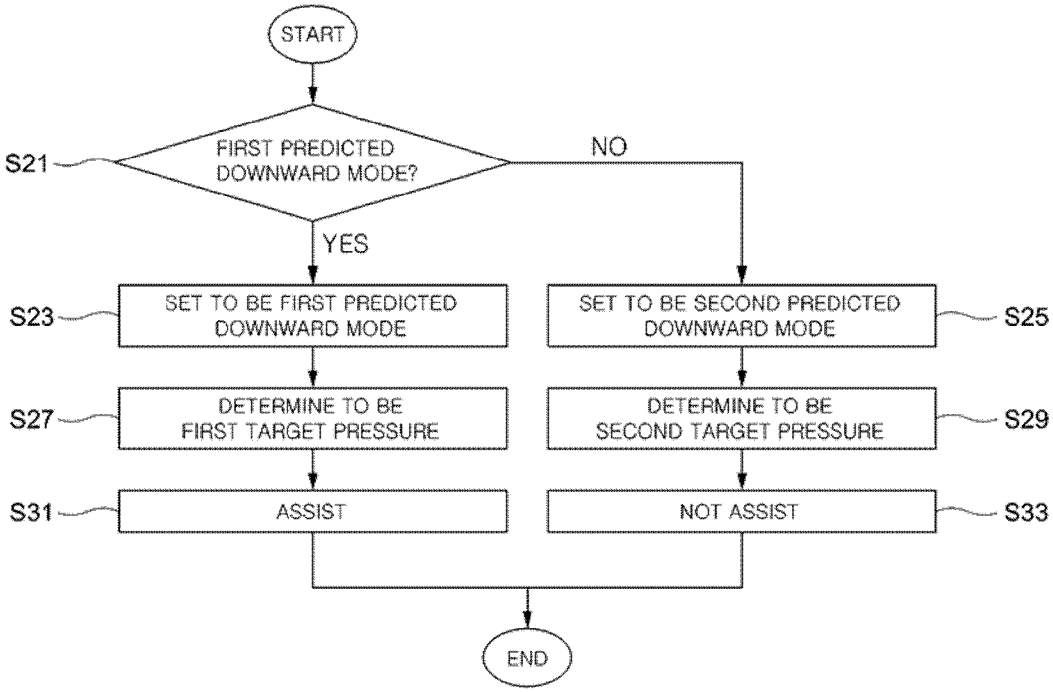

[Fig. 7]
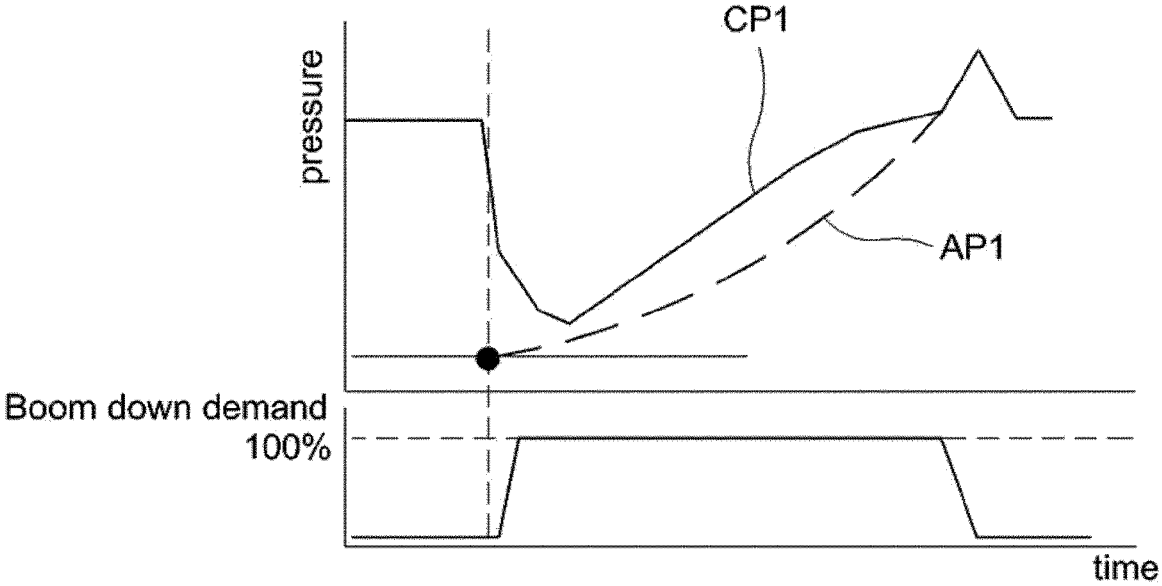
[Fig. 8]
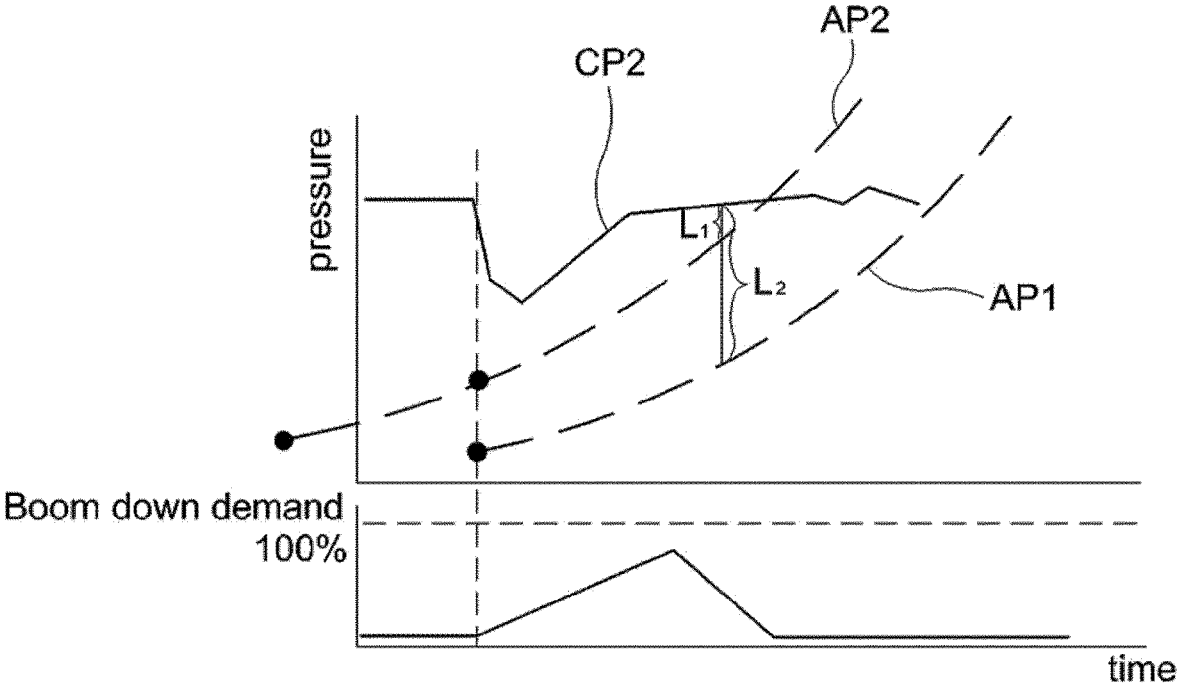

[Fig. 9]
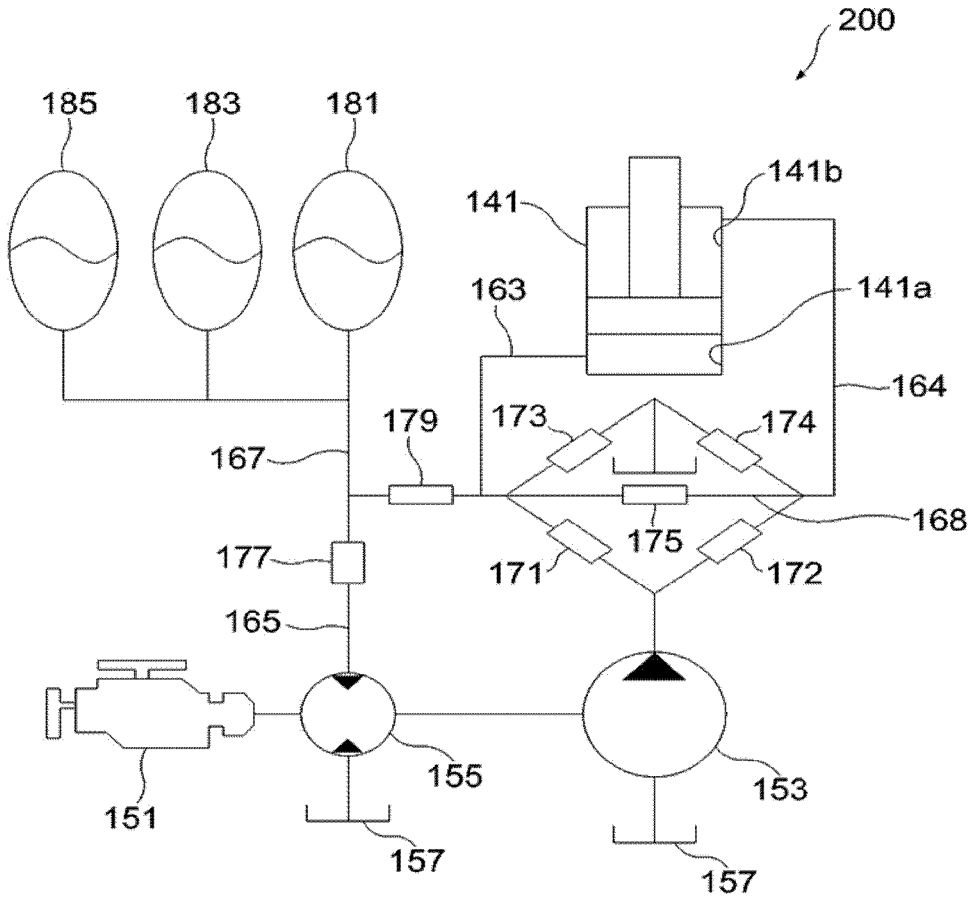
[Fig. 10]
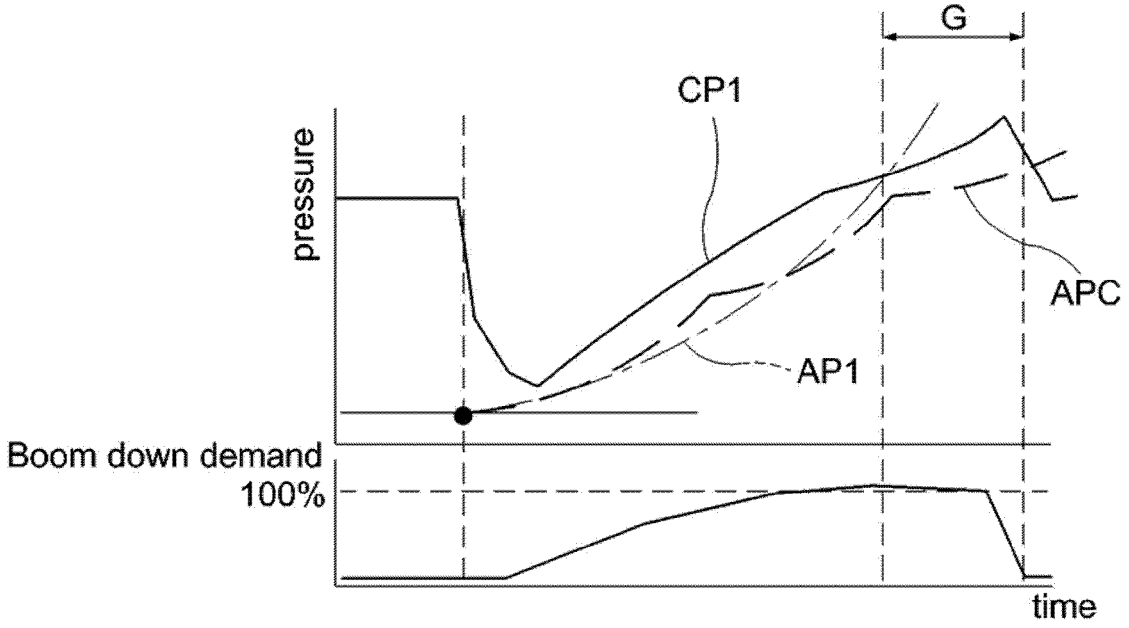

[Fig. 11]
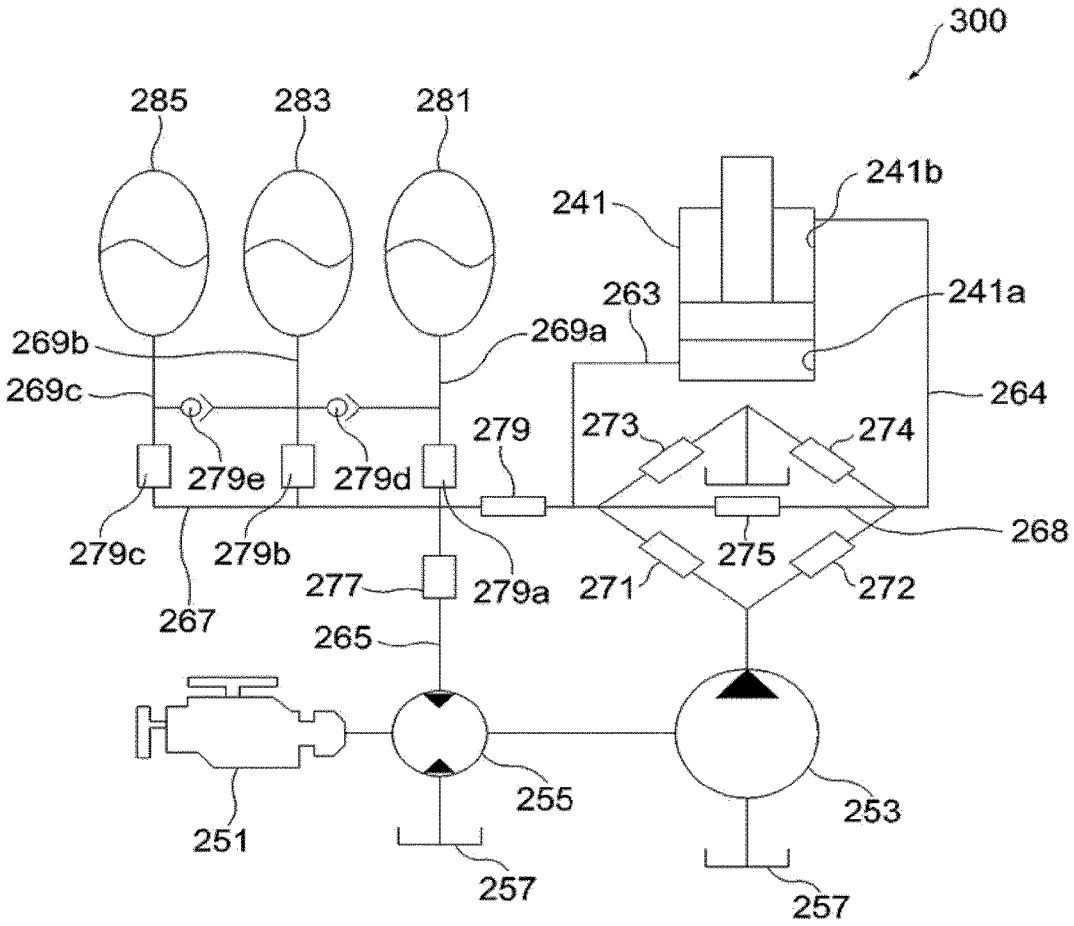
[Fig. 12]
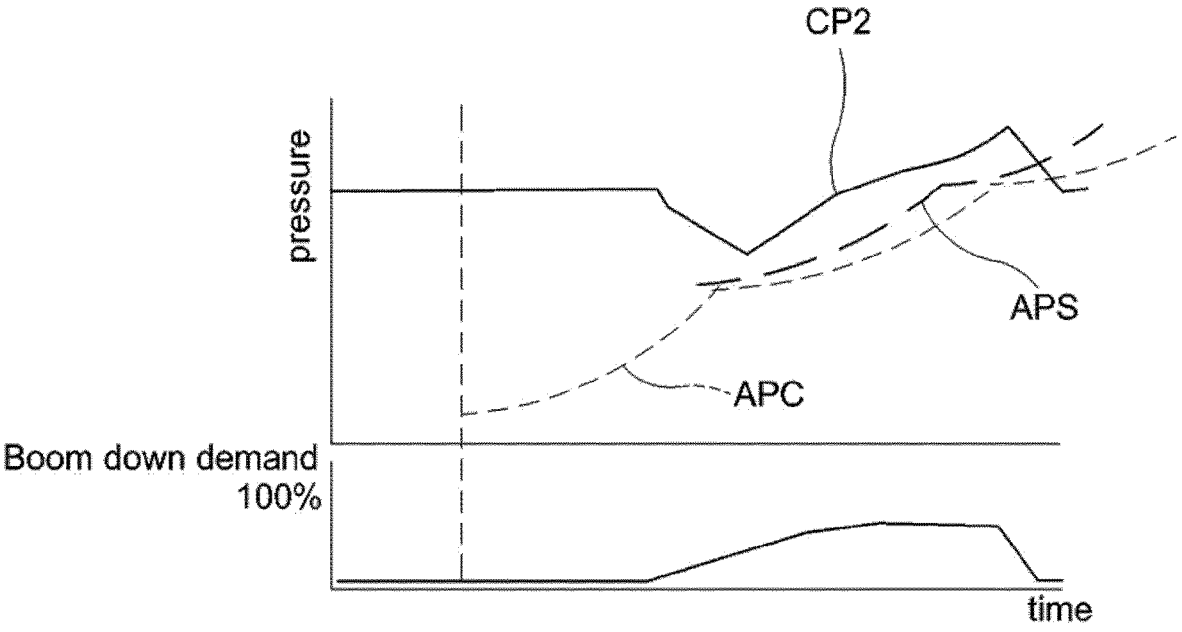

ENERGY RECUPERATION SYSTEM AND METHOD FOR CONSTRUCTION EQUIPMENT

CROSS REFERENCE TO RELATED APPLICATIONS

This application is a 35 U.S.C. § 371 national stage application of PCT International Application No. PCT/KR2017/012624 filed on Nov. 8, 2017, the disclosure and content of which is incorporated by reference herein in its entirety.

TECHNICAL FIELD

The present invention relates to energy recuperation system and method for construction equipment.

BACKGROUND ART

Construction equipment, for example, an excavator generates large force using hydraulic pressure. The force enables a work unit of the excavator to excavate earth and sand/solid rock or dump excavated earth and sand/solid rock.

In order to use this hydraulic pressure, a hydraulic pump pumps up oil stored in an oil tank and supplies the oil as a pressurized oil to an actuator that actuates the work unit. An engine needs to be operated to drive the hydraulic pump and fuel needs to be consumed to operate the engine.

Energy recuperation technology has been used to increase fuel efficiency of construction equipment by reducing fuel consumption. The energy recuperation technology has a mechanism that charges an accumulator with a pressurized oil, which has been supplied to the actuator while the work unit freely drops, without discharging the pressurized oil to the oil tank and then supplies the charged oil to another hydraulic component.

According to the energy recuperation technology, an energy recuperation ratio may be low, depending on a pressure condition of the accumulator, or in order to increase an energy recuperation ratio, the response speed of an excavator may be reduced. Accordingly, energy is not efficiently recuperated.

DISCLOSURE OF INVENTION

Technical Problem

An object of the present invention is to provide energy recuperation system and method for construction equipment, the system and method being able to improve energy recuperation efficiency by maintaining a dischargeable lowest limit pressure of an accumulator at an optimum level in energy recuperation while construction equipment is in operation.

Another object of the present invention is to provide energy recuperation system and method for construction equipment, the system and method being able to increase not only a response speed of construction equipment, but also energy recuperation efficiency.

Solution to Problem

According to an exemplary embodiment of the present invention, there is provided an energy recuperation system for construction equipment including: an actuator driving upward and downward operations of a work unit; an accumulator connected to the actuator; and a controller determining a predicted downward mode associated with the downward operation of the work unit, regulating a dischargeable lowest limit pressure of the accumulator to a target pressure corresponding to the predicted downward mode, and charging the accumulator having the dischargeable lowest limit pressure regulated to the target pressure with pressurized oil discharged from the actuator during the downward operation of the work unit to recuperate energy.

The system may further include: a memory configured to store information associated with the predicted downward mode and the target pressure, and to be controlled by the controller, in which the predicted downward mode may include: a first predicted downward mode where the work unit has a first downward acceleration force at the downward operation; and a second predicted downward mode where the work unit has a second downward acceleration force at the downward operation, the second downward acceleration force being less than the first downward acceleration force, in which the target pressure may include: a first target pressure; and a second target pressure having a higher pressure level than the first target pressure, in which the controller may be configured to correspond the first predicted downward mode with the first target pressure, and to correspond the second predicted downward mode with the second target pressure.

The system may further include: a hydraulic pump configured to supply pressurized oil to the actuator; an assist motor configured to assist an engine to drive the hydraulic pump; an assist passage connecting the accumulator and the assist motor to each other; and an assist valve disposed in the assist passage and configured to control supply of the pressurized oil charged in the accumulator to the assist motor through the assist passage, in which the controller may control opening/closing of the assist valve so that the dischargeable lowest limit pressure of the accumulator reaches the first target pressure or the second target pressure.

The accumulator may include a plurality of sub-accumulators having different initial pressures, and the controller may charge a sub-accumulator, which has an initial pressure corresponding to the target pressure, of the sub-accumulators with the pressurized oil.

The system may further include: a charge passage connecting the accumulator and the actuator to each other; and a charge valve disposed in the charge passage, in which the controller may regulate pressure of the pressurized oil to be supplied into the accumulator by controlling the charge valve.

The system may further include a motion sensor configured to measure information about one of upward and downward operations of the work unit, in which the controller may acquire upward/downward operation pattern information by analyzing information measured by the motion sensor and may determine the predicted downward mode on the basis of the upward/downward operation pattern information.

The system may further include: a lower driving structure; an upper swing structure on which the work unit is mounted; and a swing module connecting the upper swing structure rotatably to the lower driving structure, in which the controller may additionally charge the accumulator, which has been charged with the pressurized oil during downward of the work unit under the second target pressure, with pressurized oil discharged from the swing module while the swing module stops a swing operation.

According to another exemplary embodiment of the present invention, there is provided an energy recuperation method for construction equipment including: determining a predicted downward mode of a work unit; regulating a dischargeable lowest limit pressure of an accumulator to a target pressure on the basis of the predicted downward mode; and charging the accumulator having the dischargeable lowest limit pressure regulated to the target pressure with pressurized oil discharged from the actuator actuating the work unit during downward of the work unit to recuperate energy.

The determining of the predicted downward mode of the work unit may further include: referring to a memory storing information about the predicted downward mode and the target pressure wherein the predicted downward mode includes a first predicted downward mode and a second predicted downward mode and the target pressure includes a first target pressure and a second target pressure having a higher pressure level than the first target pressure, and the regulating of the dischargeable lowest limit pressure of the accumulator to the target pressure on the basis of the predicted downward mode may include setting the dischargeable lowest limit pressure to the first target pressure to correspond to the first predicted downward mode, or setting the dischargeable lowest limit pressure to the second target pressure to correspond to the second predicted downward mode.

The regulating of the dischargeable lowest limit pressure of the accumulator to the target pressure on the basis of the predicted downward mode may include regulating opening/closing of an assist valve such that the dischargeable lowest limit pressure reaches the first target pressure or the second target pressure while the pressurized oil charged in the accumulator is discharged to an assist motor.

The accumulator may include a plurality of sub-accumulators having different initial pressures, and the regulating of the dischargeable lowest limit pressure of the accumulator to the target pressure on the basis of the predicted downward mode may include selecting a sub-accumulator having an initial pressure corresponding to the first target pressure or the second target pressure from the sub-accumulators as an object to be charged with the pressurized oil discharged from the actuator.

The selecting of the sub-accumulator having the initial pressure corresponding to the first target pressure or the second target pressure from the sub-accumulators as an object to be charged with the pressurized oil discharged from the actuator may include making some of the sub-accumulators be objects to be charged with pressurized oil by selectively opening/closing selection valves disposed for the sub-accumulators, respectively.

The accumulator may include a plurality of sub-accumulators having different initial pressures, and the charging of the accumulator having the dischargeable lowest limit pressure regulated to the target pressure with pressurized oil discharged from the actuator actuating the work unit during downward of the work unit to recuperate energy may include sequentially charging the sub-accumulators with the pressurized oil discharged from the actuator such that the dischargeable lowest limit pressure of the accumulator reaches the first target pressure and the second target pressure with an interval.

The determining of the predicted downward mode may include selecting one of the first predicted downward mode and the second predicted downward mode as the predicted downward mode on the basis of work input from an operator through a work selector.

The first predicted downward mode may be a mode where the work unit is turned down with a first downward acceleration force and the second predicted downward mode may be a mode where the work unit is turned down with a second downward acceleration force less than the first downward acceleration force.

The method may further include acquiring upward/downward operation pattern information by analyzing one of upward and downward operations of the work unit, in which the determining of the predicted downward mode of the work unit may include determining the predicted downward mode as one of the first predicted downward mode and the second predicted downward mode on the basis of the upward/downward operation pattern information.

The method may further include acquiring upward/downward operation pattern information by analyzing one of upward and downward operations of the work unit, in which the acquiring of the upward/downward operation pattern information by analyzing one of upward and downward operations of the work unit may include acquiring upward operation pattern information by analyzing upward factor information associated with upward of the work unit.

The upward operation pattern information may include one of a stroke value of the actuator, an operation amount of an operation lever for the actuator, operation time of the operation lever, and an upward acceleration value of the work unit.

The determining of the predicted downward mode of the work unit may include determining the predicted downward mode as the first predicted downward mode if the stroke value is larger than a reference stroke value, or determining the predicted downward mode as the second predicted downward mode if the stroke value is smaller than the reference stroke value.

The method may further include determining a starting time to charge the accumulator on the basis of the upward/downward operation pattern information.

Advantageous Effects of Invention

According to the energy recuperation system and method of the present invention, since a dischargeable lowest limit pressure of an accumulator is regulated to a target pressure suitable for a downward operation of a work unit to recuperate energy while construction equipment is in operation, pressurized oil discharged from the work unit can be maximally supplied into the accumulator, so a high energy recuperation ratio can be achieved.

Further, when the accumulator is charged with the pressurized oil, the difference between the pressure of the pressurized oil discharged from the work unit and the dischargeable lowest limit pressure of the accumulator is reduced, so a loss of pressure (a loss of energy) due to the difference can also be reduced.

Further, since the dischargeable lowest limit pressure of the accumulator is regulated, the energy of the pressurized oil discharged from the work unit can be recuperated and the response speed of operations of the work unit can be improved.

Further, since the dischargeable lowest limit pressure of the accumulator is regulated by combining different initial pressures of a plurality of sub-accumulators, it is possible to provide various designs to the accumulator in terms of energy recuperation and response speed.

BRIEF DESCRIPTION OF DRAWINGS

FIG. 1 is a perspective view showing construction equipment 100 having an energy recuperation system for construction equipment according to an embodiment of the present invention.

FIG. 2 is a conceptual view showing the main configuration of the energy recuperation system for construction equipment shown in FIG. 1.

FIG. 3 is a control block diagram of the construction equipment 100 for illustrating additional components of the energy recuperation system shown in FIG. 2.

FIG. 4 is a flow chart illustrating an energy recuperation method for construction equipment according to another embodiment of the present invention.

FIG. 5 is a flow chart illustrating in detail determining a predicted downward mode shown in FIG. 4 (S1).

FIG. 6 is a flow chart illustrating in detail regulating dischargeable lowest limit pressure of an accumulator shown in FIG. 4 (S3).

FIG. 7 is a graph showing pressure changes of a boom cylinder and an accumulator while a work unit is turned down in a first predicted downward mode.

FIG. 8 is a graph showing pressure changes of a boom cylinder and an accumulator while a work unit is turned down in a second predicted downward mode.

FIG. 9 is a conceptual view showing the main configuration of an energy recuperation system for construction equipment according to another embodiment of the present invention.

FIG. 10 is a graph showing pressure changes of a boom cylinder and an accumulator while a work unit is turned down in a first predicted downward mode in the construction equipment 200 shown in FIG. 9.

FIG. 11 is a conceptual view showing the main configuration of an energy recuperation system for construction equipment according to still another embodiment of the present invention.

FIG. 12 is a graph showing pressure changes of a boom cylinder and an accumulator while a work unit is turned down in a second predicted downward mode in the construction equipment 300 shown in FIG. 11.

BEST MODE FOR CARRYING OUT THE INVENTION

Hereinafter, energy recuperation system and method for construction equipment according to an exemplary embodiment of the present invention will be described in detail with reference to the accompanying drawings. The same and like reference numerals are used for the same and like components herein even in different embodiments and the latter description refers to the earlier description.

FIG. 1 is a perspective view showing construction equipment 100 having an energy recuperation system for construction equipment according to an embodiment of the present invention.

Referring to the figure, the construction equipment 100 will be described by exemplifying an excavator. The excavator is given reference number '100' hereafter, the same as the construction equipment 100. However, the construction equipment 100 is not limited to an excavator. The construction equipment 100 may include a back-hoe and a dragline as long as they have a work unit that is hydraulically turned up and down such as a boom or an arm.

The excavator 100 may include a lower driving structure 10, an upper swing structure 20, work units 31, 33, and 35, actuators 41, 43, and 45, and a swing module 47.

The lower driving structure 10 is disposed at a lower portion in the excavator 100 and is in charge of moving the excavator 100. The lower driving structure 10, in detail, includes a frame 11 and crawlers 16. The frame 11 has a substantially rectangular top. The crawlers 16 are coupled to both sides of the frame 11 and protrude up further than the frame 11. The crawlers 16 are rotated by power from an engine or an electric motor so that the excavator 100 can move. Unlike the crawler excavator, wheels and covers that cover the wheels may be employed instead of the crawlers 16 in a wheel excavator.

The upper swing structure 20 is disposed at an upper portion in the excavator 100 and is in direct charge of work by the excavator 100. To this end, the boom 31 of the work units 31, 33, and 35 is rotatably mounted on the upper swing structure 20. Further, the upper swing structure 20 may have a cab 21 and a machine room 26. An operator controls the work units 31, 33, and 35 by operating an operation lever 96 (see FIG. 3) in the cab 21. Hydraulic machines such as a hydraulic pump 53 (see FIG. 2) are disposed in the machine room 26 and drive the actuators 41, 43, and 45 using hydraulic power.

The work units 31, 33, and 35 are components that directly perform various works on earth and sand, or solid rocks, for example, digging and grading, using hydraulic power. The work units 31, 33, and 35, in detail, may include a boom 31, an arm 33, and a bucket 35. The boom 31 is rotatably connected to the upper swing structure 20 and the free end of the boom 31 can be moved along an arc-shaped path. The arm 33 is also rotatably connected to the free end of the boom 31. The arm 33 may be shorter than the boom 31. The bucket 35 is rotatably connected to the free end of the arm 33 and has a structure that can load earth and sand therein. Instead of the bucket 35, a ripper or a crusher may be coupled to the arm 33.

The actuators 41, 43, and 45 actuate the work units 31, 33, and 35 by supplying hydraulic power to the work units 31, 33, and 35. The actuators 41, 43, and 45, in detail, may include a boom cylinder 41, an arm cylinder 43, and a bucket cylinder 45. The boom cylinder 41 connects the upper swing structure 20 and the arm cylinder 43 to turn up and down the boom 31 by stretching and contracting. The arm cylinder 43 connects the boom 31 and the arm 33 to each other to turn up and down the arm 33. Similarly, the bucket cylinder 45 connects the bucket 35 and the arm 33 to each other to turn up and down the bucket 35.

The swing module 47 connects the lower driving structure 10 and the upper swing structure 20 to each other. Further, the swing module 170 includes parts such as a swing bearing that enables the upper swing structure 20 to swing with respect the lower driving structure 10 and a swing motor that generates hydraulic force for a swing operation.

The energy recuperation system and method according to the present invention are described with a focus on the boom 31 of the work units 31, 33, and 35. Accordingly, the actuators 41, 43, and 45 are described with a focus on the boom cylinder 41 associated with the boom 31. Even though described with a focus on the boom 31 and the boom cylinder 41, the energy recuperation system and method can be equivalently applied to the arm 33 and the arm cylinder 43, etc.

FIG. 2 is a conceptual view showing the main configuration of the energy recuperation system for construction equipment shown in FIG. 1.

Referring to FIG. 2, the energy recuperation system may include a pressurized oil production module, a pressurized oil guide module, a pressurized flow control module, and a pressurized oil storage module.

The pressurized oil production module produces a pressurized oil at high pressure, for example, a pressurized oil having pressure required for the boom cylinder 41 from oil at the atmospheric pressure. The pressurized oil production module may include an engine 51, a hydraulic pump 53, an assist motor 55, and an oil tank 57. The engine 51 generates mechanical torque by burning fuel such as diesel. The hydraulic pump 53 is rotated by the torque from the engine 51, thereby pumping the oil in the oil tank 57 as the pressurized oil. The assist motor 55 is disposed between the engine 51 and the hydraulic pump 53 and assists the engine 51 to rotate the hydraulic pump 53. The assist motor 55 is a hydraulic motor that is operated by hydraulic pressure.

The pressurized oil guide module has passages for guiding the pressurized oil discharged from the hydraulic pump 53 to the boom cylinder 41, the assist motor 55, the oil tank 57, or an accumulator 81. The passages, in detail, may include an output passage 61, a supply passage A 63, a supply passage B 64, an assist passage 65, and a charge passage 67. The output passage 61 means a passage through which the pressurized oil is discharged from the hydraulic pump 53. The supply passage A 63 is connected to the output passage 61 and to a chamber A 41*a* of the boom cylinder 41. The supply passage B 64 is connected to the output passage 61 and to a chamber B 41*b* of the boom cylinder 41. The assist passage 65 connects the assist motor 55 and the accumulator 81 to each other. The charge passage 67 connects the supply passage A 63 and the accumulator 81 to each other. Further, there may be provided a bridge passage 68 connecting the supply passage A 63 and the supply passage B 64 to each other and a return passage 69 connecting the supply passage A 63 and the supply passage B 64 to the oil tank 57.

The pressurized flow control module controls flow of the pressurized oil in the passages by opening/closing the passages. The pressurized flow control module may include a supply valve A 71, a supply valve B 72, a return valve A 73, a return valve 74, a bridge valve 75, an assist valve 77, and a charge valve 79. The supply valve A 71 is disposed in the supply passage A 63 and controls the pressurized oil that is supplied to the chamber A 41*a* of the boom cylinder 41 through the output passage 61 and the supply passage A 63. The supply valve B 72 is disposed in the supply passage B 64 and controls the pressurized oil that is supplied to the chamber B 41*b* of the boom cylinder 41 through the output passage 61 and the supply passage B 64. The return valve A 73 and the return valve B 74 open/close the passage for returning the pressurized oil from the chamber A 41*a*/chamber B 41*b* of the boom cylinder 41 to the oil tank 57. The bridge valve 75 is disposed in the bridge passage 68 and controls the pressurized oil that is supplied from one of the chamber A 41*a* and the chamber B 41*b* to the other one. The assist valve 77 controls the pressurized oil that is supplied to the assist module 55 from the accumulator 81. The charge valve 79 is disposed in the charge passage 67 and opened/closed so that the pressurized oil discharged from the chamber 41*a* is supplied into the accumulator 81 or stops being supplied.

FIG. 3 is a control block diagram of the construction equipment 100 for illustrating additional components of the energy recuperation system shown in FIG. 2.

Referring to this figure, the excavator 100, in addition to the engine 51 and valves 71, 72, 73, 74, 75, 77, and 79, may further include a controller 91, a motion sensor 93, a work selector 95, an operation lever 96, and a memory 97.

The controller 91 is electrically connected to the engine 51, the valves 71, 72, 73, 74, 75, 77, and 79, the motion sensor 93, and the like, thereby controlling them or receiving information from them. The controller 91 controls the assist valve 77, the charge valve 79 etc. to recuperate energy from the pressurized oil discharged from the boom cylinder 41, which will be described with reference to FIG. 4 etc.

Referring back to FIG. 3, the motion sensor 93 acquires information about an upward operation and a downward operation of the boom 31. To this end, a sensor that measures upward angle/upward acceleration/stroke of the boom 31 or a sensor that measures operation amount/operation time of the operation lever 96 may be employed as the motion sensor 93.

The work selector 95 is provided to select next works to be performed by an operator. The controller 91 can predict information about an upward operation and a downward operation of the boom 31 during working from a selected work. The work selector 95 may be a manual button for selecting exemplary works or a touch button on a control screen.

The operation lever 96 produces instructions for an upward operation and a downward operation of the boom 31 when being operated by the operator, and inputs the instructions to the controller 91.

The memory 97 stores information on a predicted downward mode associated with a downward operation of the boom 31 and a target pressure of the accumulator 81 (see FIG. 2). The predicted downward mode is divided into a first predicted downward mode and a second predicted downward mode on the basis of the downward acceleration force of the boom 31. The downward acceleration force is larger in the first predicted downward mode than in the second predicted downward mode. The target pressure is a target pressure value for setting the dischargeable lowest limit pressure of the accumulator 81. The dischargeable lowest limit pressure means the lower limit of pressure that the accumulator 81 can have in consideration of the efficiency of recuperating energy from the boom cylinder 41 under the assumption that a pressurized oil is maximally discharged and sent to the assist motor 55 from the accumulator 81.

The target pressure may be divided into a first target pressure and a second target pressure higher than the first target pressure. A control program may be stored in the memory 97. The control program may contain instructions to correspond the first target pressure with the first predicted downward mode and the second target pressure with the second predicted downward mode.

The energy recuperation method is described hereafter with reference to FIGS. 4 to 6 on the basis of the above description.

FIG. 4 is a flow chart illustrating an energy recuperation method for construction equipment according to another embodiment of the present invention.

Referring to this figure (and FIGS. 1 to 3), the energy recuperation method may include determining a predicted downward mode (S1), regulating a dischargeable lowest limit pressure of the accumulator (S3), and charging the accumulator (S5).

First, in the determining of the predicted downward mode (S1), the controller 91 predicts which mode the boom 31 is turned down in after an upward operation. As described above, the controller 91 determines whether the predicted downward mode is the first predicted downward mode or the second predicted downward mode. The predicted downward modes are obtained by predicting actual downward operations of the boom 31, but the actual downward operations may not follow the predicted downward modes.

In the regulating of the dischargeable lowest limit pressure of the accumulator (S3), the controller 91 differently regulates the dischargeable lowest limit pressure of the accumulator 81, depending on the predicted downward modes. In other words, the controller 91 should increase or decrease the dischargeable lowest limit pressure of the accumulator 81.

In the charging of the accumulator (S5), the controller 91 opens the charge valve 79 so that the accumulator 81 is charged with the pressurized oil in the chamber A 41*a* of the boom cylinder 41 through the charge passage 67. The accumulator 81 is charged while the boom 31 is actually turned down. In detail, the pressurized oil in the chamber A 41*a* of the boom cylinder 41 is not discharged to the oil tank 57, but supplied into the accumulator 81 to turn down the boom 31, thereby recuperating the energy of the pressurized oil. Further, as the pressurized oil in the chamber A 41*a* is discharged to the accumulator 81, the boom 31 is freely dropped by its own weight.

The controller 91 can regulate the flow rate of the pressurized oil to be supplied into the accumulator 81 by controlling the charge valve 79. The control of a flow rate is in connection with the pressure of the pressurized oil that is supplied into the accumulator 81. Accordingly, as the pressure of the pressurized oil is regulated, the speed of the pressurized oil discharged from the chamber A 41*a* can be regulated. This means that the downward speed of the boom 31 is regulated, so the response speed of the excavator 100 can be regulated.

The determining of the predicted downward mode (S1) is described hereafter with reference to FIG. 5.

FIG. 5 is a flow chart illustrating in detail the determining of the predicted downward mode (S1).

Referring to this figure (and FIGS. 1 to 3), the controller 91 analyzes first (actual) upward and downward operations of the boom 31 to determine a predicted downward mode of the boom 31 (S11). Operation information about one or several upward operations and downward operations of the boom 31 is stored in the memory 97 to analyze operations of the boom 31. The operation information may include upward angle/acceleration force or the like when the boom 31 is turned up and downward angle/acceleration force when the boom 31 is turned down. The controller 91 can analyze the upward and downward operations for those operations with reference to the memory 97.

Next, the controller 91 determines whether it is possible to acquire upward/downward operation pattern information through the operation analysis, and if possible, it can acquire the information (S13 and S15). The upward/downward operation pattern information is defined by finding predetermined patterns in the upward operations and the downward operations from the operation information. The upward/downward operation pattern information may include, for example, information that the boom 31 is quickly turned up and also quickly turned down. Further, the upward/downward operation pattern information may include information about the interval between the end of the upward operation and the beginning of the downward operation. Accordingly, the controller 91 can determine when to charge the accumulator 81 on the basis of the information about the interval.

The controller 91 may refer to only upward operation pattern information as a part of the upward/downward operation pattern information (S17). The upward operation pattern information means which pattern the upward/downward operation shows. For example, the upward/downward operation pattern information is information about whether the boom 31 has been turned up a little or a lot. Under a common work environment, when the boom 31 has been turned up a little, the boom 31 will be turned down at a low acceleration force, while when the boom 31 has been turned up a lot, the boom 31 will be turned down at a large acceleration force. The controller 91 can determine the predicted downward mode on the basis of this estimation. The upward operation pattern information can be acquired by analyzing upward factor information associated with the upward operation of the boom 31. The upward factor information, for example, may be any one of an upward acceleration value of the boom 31, an upward stroke value of the boom cylinder 41 driving the boom 31, and the operation amount or operation time of the operation lever 96 driving the boom cylinder 41.

Accordingly, it is possible to determine a predicted downward mode of the boom 31 as a first predicted downward mode and a second predicted downward mode on the basis of the information about the upward operations and the downward operations included in the upward/downward operation pattern information (S19). For example, if the downward operation with large downward acceleration force is repeated after the upward operation, the controller 91 can determine the predicted downward mode as the first predicted downward mode.

Unlikely, the controller 91 can determine the predicted downward mode from an upward operation immediately before a downward operation of the boom 31 on the basis of the upward operation pattern information. For example, if the boom 31 is turned up a little in the upward operation (the upward stroke value is smaller than a reference stroke value), it is possible to determine the predicted downward mode as the second predicted downward mode by predicting that the downward acceleration force of the boom 31 would also be small while the boom 31 is turned down. Unlikely, if the upward stroke value is larger than the reference stroke value, it is possible to determine the predicted downward mode as the first predicted downward mode.

Further, the controller 91 can determine a predicted downward mode of the boom 31 as one of a first predicted downward mode and a second predicted downward mode in the above work on the basis of work inputted by an operator through the work selector 95. For example, if an operate selects grading, the controller 91 can predict that the downward acceleration force of the boom 31 would be small on the basis of a grading pattern. Accordingly, the controller 91 can determine the predicted downward mode as the second predicted downward mode.

FIG. 6 is a flow chart illustrating in detail the regulating of the dischargeable lowest limit pressure of the accumulator shown in FIG. 4 (S3).

Referring to the figure (and FIGS. 1 to 3), depending on whether the predicted downward mode is the first predicted downward mode (S21), the controller 91 differently regulates corresponding dischargeable lowest limit pressure of the accumulator 81.

In detail, when the predicted downward mode is a first predicted downward mode, the controller 91 determines the dischargeable lowest limit pressure of the accumulator 81 as the first target pressure (S23 and S27). Unlikely, when the predicted downward mode is a second predicted downward mode, the controller 91 determines the dischargeable lowest limit pressure of the accumulator 81 as the second target pressure (S25 and S29).

In order to finally set the dischargeable lowest limit pressure to the first target pressure, the controller 91 opens the assist valve 77 so that the pressurized oil charged in the accumulator 81 is supplied to the assist motor 55 (S31). If the pressurized oil is being supplied to the assist motor 55, the controller 91 can keep the pressurized oil being supplied for a predetermined time. Accordingly, the dischargeable lowest limit pressure of the accumulator 81 is reduced to the first target pressure.

On the contrary, in order to finally set the dischargeable lowest limit pressure to the second target pressure, the controller 91 closes the assist valve 77 so that the pressurized oil in the accumulator 81 is maintained therein. Accordingly, the pressurized oil is not supplied to the assist motor 55 (S33). If the pressurized oil is being supplied to the assist motor 55, the controller 91 can stop the supply to the assist motor 55. Accordingly, the dischargeable lowest limit pressure of the accumulator 81 can reach the second target pressure higher than the first target pressure.

With the dischargeable lowest limit pressure of the accumulator 81 reaching the second target pressure, the accumulator 81 can be additionally charged with the pressurized oil in the swing module 47 after the accumulator 81 is charged with the pressurized oil from the boom cylinder 41. This is a method of additionally recuperating energy from the pressurized oil that is discharged from the swing module 47 while the swing module 47 stops a swing operation.

Energy recuperation efficiency while the accumulator 81 is charged with the pressurized oil discharged from the boom cylinder 41 is described hereafter.

FIG. 7 is a graph showing pressure changes of a boom cylinder and an accumulator while a work unit is turned down in a first predicted downward mode.

Referring to this figure (and FIGS. 1 to 3), when an operator rapidly operates the operation lever 96 to turn down the boom 31, the controller 91 is supposed to quickly discharge pressurized oil in the chamber A 41*a* of the boom cylinder 41.

The controller 91 has determined the predicted downward mode as the first predicted downward mode by predicting this situation in advance. The controller 91 has set the dischargeable lowest limit pressure of the accumulator 81 to the first target pressure before the boom 31 is actually turned down.

Accordingly, even if the pressurized oil in the chamber A 41*a* is quickly discharged and the pressure CP1 in the chamber A 41*a* is greatly reduced, the minimum of the pressure of the pressurized oil discharged from the chamber A 41*a* can be regulated to be slightly larger than or equivalent to the first target pressure AP1. Therefore, most of the pressurized oil in the chamber A 41*a* can be supplied into the accumulator 81 without being discharged to the oil tank 57. Further, as the accumulator 81 is charged with the pressurized oil, the size of the first target pressure AP1 constructs a gradually increasing line.

Accordingly, all of the pressurized oil discharged from the boom cylinder 41 is restored, so the energy recuperation efficiency can be maximized. Further, since the pressurized oil is quickly discharged from the boom cylinder 41, the response speed for the downward operation of the boom 31 to operation for downward by an operator can be increased.

If the dischargeable lowest limit pressure of the accumulator 81 has reached the second target pressure, the controller 91 cannot rapidly discharge the pressurized oil in the chamber A 41*a* in order to increase the energy recuperation efficiency. This reduces the response speed for the downward operation of the boom 31, which may cause complaint of the operator.

FIG. 8 is a graph showing pressure changes of a boom cylinder and an accumulator while a work unit is turned down in a second predicted downward mode.

Referring to this figure (and FIGS. 1 to 3), when an operator smoothly pulls the operation lever 96 to turn down the boom 31, the controller 91 is supposed to discharge only slightly the pressurized oil in the chamber A 41*a* of the boom cylinder 41.

The controller 91 has determined the predicted downward mode as the second predicted downward mode by predicting this situation in advance. The controller 91 has set the dischargeable lowest limit pressure of the accumulator 81 to the second target pressure CP2 before the boom 31 is actually turned down.

Accordingly, even if the pressurized oil in the chamber A 41*a* is slowly discharged and the pressure CP2 in the chamber A 41*a* is slightly reduced, the minimum of the pressure of the pressurized oil discharged from the chamber A 41*a* can be regulated to be slightly larger than or equivalent to the second target pressure AP2. Therefore, most of the pressurized oil discharged from the chamber A 41*a* can be supplied into the accumulator 81 without being discharged to the oil tank 57. Further, as the accumulator 81 is charged with the pressurized oil, the size of the second target pressure AP2 constructs a gradually increasing line.

It can be seen that the pressure difference L1 between the pressure CP2 of the pressurized oil in the chamber A 41*a* and the second target pressure AP2 is smaller than the pressure difference L2 between the pressure CP2 of the pressurized oil in the chamber A 41*a* and the first target pressure AP1. This means that it is possible to reduce a loss of energy due to a pressure difference by regulating the dischargeable lowest limit pressure of the accumulator 81 to the second target pressure AP2 rather than the first target pressure AP1.

FIG. 9 is a conceptual view showing the main configuration of an energy recuperation system for construction equipment according to another embodiment of the present invention.

Referring to FIG. 9, construction equipment 200 is similar to the construction equipment 100 of the previous embodiment for the most part, but is different from the construction equipment 100 having only one accumulator 81 in that it has a plurality of sub-accumulators.

Three sub-accumulators 181, 183, and 185 are exemplified as the plurality of sub-accumulators. The sub-accumulators 181, 183, and 185 are connected in parallel to a charge passage 167. The sub-accumulators 181, 183, and 185 have different initial pressures. The initial pressures mean precharged gas pressure of the sub-accumulators 181, 183, and 185. For example, the initial pressures of a first sub-accumulator 181, a second sub-accumulator 183, and a third sub-accumulator 185 may be 80 bar, 150 bar, and 200 bar, respectively. In this configuration, the pressure of a boom cylinder 141 is higher than the initial pressure of the third sub-accumulator 185, for example, may be 250 bar.

According to this configuration, the sub-accumulators 181, 183, and 185 can be sequentially charged with pressurized oil that is discharged from a chamber A 141*a* through the charge passage 167 during a downward operation of the boom cylinder 141.

The charging process is described hereafter in detail with reference to FIG. 10.

FIG. 10 is a graph showing pressure changes of a boom cylinder and an accumulator while a work unit is turned down in a first predicted downward mode in the construction equipment 200 shown in FIG. 9.

Referring to this figure (and FIG. 9), when an operator rapidly pulls the operation lever 96 to turn down the boom 31, the controller 91 is supposed to quickly discharge pressurized oil in the chamber A 141*a* of the boom cylinder 141.

The controller 91 has determined the predicted downward mode as the first predicted downward mode by predicting this situation in advance. The controller 91 has set the dischargeable lowest limit pressure of the accumulator to the first target pressure before the boom 31 is actually turned down. As a detailed method for this purpose, the controller 91 opens a charge valve 179 so that one, which has an initial pressure corresponding to the first target pressure, of the sub-accumulators 181, 183, and 185, is selected and charged with pressurized oil in the chamber A 141*a*. If the dischargeable lowest limit pressure of the accumulator has to be set to the second target pressure, the pressurized oil discharged from the chamber A 141*a* may be supplied into the sub-accumulator having an initial pressure corresponding to the second target pressure of the sub-accumulators 181, 183, and 185. This is because the pressurized oil cannot be supplied into sub-accumulators having an initial pressure lower than the second target pressure.

Accordingly, when the pressurized oil in the chamber A 141*a* is discharged, the pressure change of the accumulator does not follow the existing graph AP1, but follows a pressure change graph APC by combination of the three sub-accumulators 181, 183, and 185. In other words, the first sub-accumulator 181 having the lowest initial pressure to the third sub-accumulator 185 having the highest initial pressure can be sequentially charged with the pressurized oil.

When the pressure change of the accumulator follows the graph AP1, the dischargeable lowest limit pressure of the accumulator is higher than the pressure of the pressurized oil in the loss period G, so the pressurized oil cannot be supplied into the accumulator. Accordingly, the pressurized oil in the chamber A 141*a* has to be sent to the oil tank 157, so energy cannot be recuperated from the pressurized oil.

Unlikely, when the pressure change of the accumulator follows a new graph APC, the pressure of the pressurized oil is higher than the dischargeable lowest limit pressure of the accumulator even in the loss period G, so the pressurized oil cannot be supplied into the accumulator.

FIG. 11 is a conceptual view showing the main configuration of an energy recuperation system for construction equipment according to another embodiment of the present invention.

Referring to FIG. 11, construction equipment 300 according to a new embodiment, similar to the construction equipment 200 of the previous embodiment, has a plurality of sub-accumulators 281, 283, and 285 having different initial pressures as accumulators. The initial pressures of the sub-accumulators 281, 283, and 285 may be 80 bar, 150 bar, and 200 bar, respectively, the same as in the previous embodiment.

The sub-accumulators 281, 283, and 285 are connected to each other by inflow passages 269*a*, 269*b*, and 269*c* in parallel with a charge passage 267. Selection valves 279*a*, 279*b*, and 279*c* are respectively disposed in the inflow passages 269*a*, 269*b*, and 269*c*. The controller 91 can make the sub-accumulators 281, 283, and 285 be objects to be charged or not with pressurized oil by selectively opening/closing the selection valves 279*a*, 279*b*, and 279*c*.

Further, check valves 279*d* and 279*e* may be disposed between the inflow passages 269*a*, 269*b*, and 269*c*. The check valves 279*d* and 279*e* allow sub-accumulators having a higher initial pressure to be charged with the pressurized oil as the pressure of the pressurized oil increases after sub-accumulators having a lower initial pressure is charged with the pressurized oil, but does not allow for the opposite case.

A charge operation in the construction equipment 300 is described hereafter in detail with reference to FIG. 12.

FIG. 12 is a graph showing pressure changes of a boom cylinder and an accumulator while a work unit is turned down in a second predicted downward mode in the construction equipment 300 shown in FIG. 11.

Referring to this figure (and FIG. 11), when an operator smoothly pulls the operation lever 96 to turn down the boom 31, the controller 91 is supposed to only slightly discharge pressurized oil in the chamber A 241*a* of the boom cylinder 241.

The controller 91 has determined the predicted downward mode as the second predicted downward mode by predicting this situation in advance. Accordingly, the controller 91 has set the dischargeable lowest limit pressure of an accumulator to the second target pressure before the boom 31 is actually turned down.

As a detailed method of setting the second target pressure, the controller 91 opens the charge valve 279 and opens only a second selection valve 279*b* of the selection valves 279*a*, 279*b*, and 279*c*. Accordingly, the pressurized oil in the boom cylinder 241 is supplied first into the second sub-accumulator 283. Thereafter, when the pressure of the pressurized oil increases, the pressurized oil can be supplied a third sub-accumulator 285 through a second check valve 279*e*. This process can be seen from a pressure change graph APS showing the actual charge process of an accumulator. Accordingly, the two sub-accumulators 283 and 285 are sequentially charged with the pressurized oil, but the initial pressures are different, so the dischargeable lowest limit pressures of the accumulators can reach the first target pressure and the second target pressure with an interval.

For reference, another pressure change graph APC of the accumulators show a pressure change when the first selection valve 279*a* is opened with the charge valve 279 by the controller 91 and the first sub-accumulator 281 to the third sub-accumulator 285 are sequentially charged with the pressurized oil.

As a result, since the controller 91 opens not the first selection valve 279*a*, but the second selection valve 279*b*, it is possible to set the dischargeable lowest limit pressure of the accumulator to the second target pressure. Accordingly, it is possible to prevent a decrease in energy recuperation ratio due to a loss of pressure while an accumulator is charged with the pressurized oil.

The energy recuperation systems and methods for construction equipment described above are not limited to the configurations and operation methods of the embodiments described above. The embodiments may be selectively partially or fully combined for various modifications.

INDUSTRIAL APPLICABILITY

The present invention has industrial applicability to an energy recuperation system and method for construction equipment.

The invention claimed is:

1. An energy recuperation system for construction equipment, comprising:

an actuator configured to drive an upward operation and a downward operation of a work unit;

an accumulator connected to the actuator; and a controller configured to determine a predicted downward mode associated with the downward operation of the work unit, to regulate a dischargeable lowest limit pressure of the accumulator to a target pressure corresponding to the predicted downward mode, and to charge the accumulator having the dischargeable lowest limit pressure regulated to the target pressure with pressurized oil discharged from the actuator during the downward operation of the work unit such that an energy recuperation is achieved.

2. The system of claim 1, further comprising:

a memory configured to store information associated with the predicted downward mode and the target pressure, and to be controlled by the controller, wherein the predicted downward mode includes:

a first predicted downward mode where the work unit has a first downward acceleration force at the downward operation; and a second predicted downward mode where the work unit has a second downward acceleration force at the downward operation, the second downward acceleration force being less than the first downward acceleration force, wherein the target pressure includes:

a first target pressure; and a second target pressure having a higher pressure level than the first target pressure, and wherein the controller is configured to correspond the first predicted downward mode with the first target pressure, and to correspond the second predicted downward mode with the second target pressure.

3. The system of claim 2, further comprising:

a hydraulic pump configured to supply the pressurized oil to the actuator;

an assist motor configured to assist an engine to drive the hydraulic pump;

an assist passage configured to connect the accumulator and the assist motor to each other; and an assist valve disposed in the assist passage and configured to control supply of the pressurized oil charged in the accumulator to the assist motor through the assist passage, wherein the controller controls opening/closing of the assist valve so that the dischargeable lowest limit pressure of the accumulator reaches the first target pressure or the second target pressure.

4. The system of claim 2, further comprising:

a lower driving structure;

an upper swing structure on which the work unit is mounted; and a swing module connecting the upper swing structure rotatably to the lower driving structure, wherein the controller additionally charges the accumulator, which has been charged with the pressurized oil during downward of the work unit under the second target pressure, with pressurized oil discharged from the swing module while the swing module stops a swing operation.

5. The system of claim 1, wherein the accumulator includes a plurality of sub-accumulators having different initial pressures, wherein the controller charges a sub-accumulator, which has an initial pressure corresponding to the target pressure, of the sub-accumulators with the pressurized oil.

6. The system of claim 1, further comprising:

a charge passage connecting the accumulator and the actuator to each other; and a charge valve disposed in the charge passage, wherein the controller regulates pressure of the pressurized oil to be supplied into the accumulator by controlling the charge valve.

7. The system of claim 1, further comprising a motion sensor configured to measure information about one of the upward and downward operations of the work unit, wherein the controller acquires upward/downward operation pattern information by analyzing information measured by the motion sensor and determines the predicted downward mode on the basis of the upward/downward operation pattern information.

8. An energy recuperation method for construction equipment, the method comprising:

determining a predicted downward mode of a work unit;

regulating a dischargeable lowest limit pressure of an accumulator to a target pressure on the basis of the predicted downward mode; and charging the accumulator having the dischargeable lowest limit pressure regulated to the target pressure with pressurized oil discharged from an actuator actuating the work unit during downward of the work unit to recuperate energy.

9. The method of claim 8, wherein the determining of the predicted downward mode of the work unit includes:

referring to a memory storing information about the predicted downward mode and the target pressure, wherein the predicted downward mode includes a first predicted downward mode and a second predicted downward mode and the target pressure includes a first target pressure and a second target pressure having a higher pressure level than the first target pressure, wherein the regulating of the dischargeable lowest limit pressure of the accumulator to the target pressure on the basis of the predicted downward mode includes:

setting the dischargeable lowest limit pressure to the first target pressure to correspond to the first predicted downward mode or setting the dischargeable lowest limit pressure to the second target pressure to correspond to the second predicted downward mode.

10. The method of claim 9, wherein the regulating of the dischargeable lowest limit pressure of the accumulator to the target pressure on the basis of the predicted downward mode includes:

regulating opening/closing of an assist valve such that the dischargeable lowest limit pressure reaches the first target pressure or the second target pressure while the pressurized oil charged in the accumulator is discharged to an assist motor.

11. The method of claim 9, wherein the accumulator includes a plurality of sub-accumulators having different initial pressures, and wherein the regulating of the dischargeable lowest limit pressure of the accumulator to the target pressure on the basis of the predicted downward mode includes:

selecting a sub-accumulator having an initial pressure corresponding to the first target pressure or the second target pressure from the sub-accumulators as an object to be charged with the pressurized oil discharged from the actuator.

12. The method of claim 11, wherein the selecting of the sub-accumulator having the initial pressure corresponding to the first target pressure or the second target pressure from the sub-accumulators as an object to be charged with the pressurized oil discharged from the actuator includes:

making some of the sub-accumulators be objects to be charged by selectively opening/closing selection valves disposed for the sub-accumulators, respectively.

13. The method of claim 9, wherein the accumulator includes a plurality of sub-accumulators having different initial pressures, wherein the charging of the accumulator having the dischargeable lowest limit pressure regulated to the target pressure with pressurized oil discharged from the actuator actuating the work unit during downward of the work unit to recuperate energy includes:

sequentially charging the sub-accumulators with the pressurized oil discharged from the actuator such that the dischargeable lowest limit pressure of the accumulator reaches the first target pressure and the second target pressure with an interval.

14. The method of claim 9, wherein the determining of the predicted downward mode includes:

selecting one of the first predicted downward mode and the second predicted downward mode as the predicted downward mode on the basis of work input from an operator through a work selector.

15. The method of claim 9, wherein the first predicted downward mode is a mode where the work unit is turned down with a first downward acceleration force and the second predicted downward mode is a mode where the work unit is turned down with a second downward acceleration force less than the first downward acceleration force.

16. The method of claim 15, further comprising:

acquiring upward/downward operation pattern information by analyzing one of upward and downward operations of the work unit, wherein the determining of the predicted downward mode of the work unit includes:

determining the predicted downward mode as one of the first predicted downward mode and the second predicted downward mode on the basis of the upward/downward operation pattern information.

17. The method of claim 16, further comprising:

determining a starting time to charge the accumulator on the basis of the upward/downward operation pattern information.

18. The method of claim 15, further comprising:

acquiring upward/downward operation pattern information by analyzing one of upward and downward operations of the work unit, wherein the acquiring of the upward/downward operation pattern information by analyzing one of upward and downward operations of the work unit includes:

acquiring upward operation pattern information by analyzing upward factor information associated with upward of the work unit.

19. The method of claim 18, wherein the upward operation pattern information includes one of a stroke value of the actuator, an operation amount of an operation lever for the actuator, operation time of the operation lever, and an upward acceleration value of the work unit.

20. The method of claim 19, wherein the determining of the predicted downward mode of the work unit includes:

determining the predicted downward mode as the first predicted downward mode if the stroke value is larger than a reference stroke value, or determining the predicted downward mode as the second predicted downward mode if the stroke value is smaller than the reference stroke value.

* * * * *